US010997946B2

(12) United States Patent
Selan et al.

(10) Patent No.: US 10,997,946 B2
(45) Date of Patent: May 4, 2021

(54) DISPLAY WITH ADJUSTABLE DUTY CYCLE FOR INDIVIDUAL COLOR CHANNELS

(71) Applicant: VALVE CORPORATION, Bellevue, WA (US)

(72) Inventors: Jeremy Selan, Bellevue, WA (US); Montgomery V. Goodson, Kirkland, WA (US)

(73) Assignee: VALVE CORPORATION, Bellevue, WA (US)

( * ) Notice: Subject to any disclaimer, the term of this patent is extended or adjusted under 35 U.S.C. 154(b) by 94 days.

(21) Appl. No.: 15/786,871

(22) Filed: Oct. 18, 2017

(65) Prior Publication Data

US 2019/0114991 A1 Apr. 18, 2019

(51) Int. Cl.

| | |
|---|---|
| ***G09G 5/02*** | (2006.01) |
| ***G09G 3/34*** | (2006.01) |
| ***G09G 3/3208*** | (2016.01) |
| ***G09G 3/20*** | (2006.01) |
| ***G09G 3/32*** | (2016.01) |

(52) U.S. Cl.

CPC ..... *G09G 5/026* (2013.01); *G09G 3/2003* (2013.01); *G09G 3/32* (2013.01); *G09G 3/3208* (2013.01); *G09G 3/3413* (2013.01); *G09G 2310/024* (2013.01); *G09G 2320/0261* (2013.01); *G09G 2320/0266* (2013.01); *G09G 2320/064* (2013.01)

(58) Field of Classification Search

CPC ..... G09G 5/026; G09G 3/2003; G09G 2320/0261; G09G 2320/0266

USPC ..... 345/691

See application file for complete search history.

(56) References Cited

U.S. PATENT DOCUMENTS

| | | | | |
|---|---|---|---|---|
| 6,909,233 | B2 * | 6/2005 | Cok | H01L 27/3209 313/504 |
| 9,407,797 | B1 * | 8/2016 | Newell | H04N 5/23264 |
| 2006/0012708 | A1 * | 1/2006 | Rosmalen | G09G 3/3208 348/503 |
| 2007/0291198 | A1 * | 12/2007 | Shen | G09G 3/3413 349/69 |

(Continued)

*Primary Examiner* — Chanh D Nguyen
*Assistant Examiner* — Ngan T. Pham-Lu
(74) *Attorney, Agent, or Firm* — Seed Intellectual Property Law Group LLP

(57) ABSTRACT

Methods and systems relating generally to information displays, and more particularly to systems and methods for setting or dynamically adjusting the illumination pulses of a display or portions of a display on an individual color channel (typically R, G, B) basis. The illumination pulses may be adjusted for a plurality of frames at once, or on a frame by frame basis. The illumination pulses may be controlled for an entire image frame, or the illumination pulse may be controlled on a finer basis, for instance on separate areas or sub-regions of a display. Such adjustments can lead to improved sharpness, brightness, or useable lifetime of the display, and can eliminate or reduce discrepancies of visual artifacts in the visual field by providing separate or variable duty cycle capability on an individual color channel basis to the display for use in combination with display images, particularly for use with close-eye display orientations such as those used in augmented reality or virtual reality applications.

32 Claims, 16 Drawing Sheets

(56) References Cited

U.S. PATENT DOCUMENTS

| | | | | |
|---|---|---|---|---|
| 2008/0018632 | A1* | 1/2008 | Cordes | G09G 3/2011 345/208 |
| 2010/0123401 | A1* | 5/2010 | Park | H05B 45/37 315/153 |
| 2010/0231800 | A1* | 9/2010 | White | G09G 3/2022 348/663 |
| 2011/0205251 | A1* | 8/2011 | Auld | G09G 3/3413 345/690 |
| 2011/0298936 | A1* | 12/2011 | Watanabe | H04N 5/23219 348/208.4 |
| 2012/0293607 | A1* | 11/2012 | Bhogal | G06T 3/4038 348/36 |
| 2012/0307086 | A1* | 12/2012 | Jefremov | H04N 5/23258 348/208.4 |
| 2014/0307011 | A1* | 10/2014 | Ninan | G09G 3/342 345/691 |
| 2017/0308161 | A1* | 10/2017 | Richards | G09G 3/3406 |

* cited by examiner

DISPLAY WITH ADJUSTABLE DUTY CYCLE FOR INDIVIDUAL COLOR CHANNELS

BACKGROUND OF THE DISCLOSURE

1. Field of the Disclosure

The disclosure relates generally to information displays, and more particularly to systems and methods for setting or dynamically adjusting the illumination pulses of a display or portions of a display on an individual color channel (typically R, G, B) basis. The illumination pulses also may be adjusted for a plurality of frames at once, or on a frame by frame basis. The illumination pulse may be controlled for an entire frame, or the illumination pulse may be controlled on a finer basis, for instance on separate areas or sub-regions of a display. Providing different or variable illumination pulse or duty cycle capability on an individual color channel basis can lead to improved sharpness, brightness, or useable lifetime of the display, and can eliminate or reduce discrepancies of visual artifacts in the visual field, particularly for use with close-eye display orientations such as those used in augmented reality or virtual reality applications. One or more duty cycles can be adjusted in response to head movement, eye movement, or image data.

2. General Background

Systems that employ close eye-displays, such as those used in augmented reality or virtual reality, where what is shown on the display can be determined at least in part by the movement of the head and/or the eyes of the user, are sensitive to visual aberrations such as motion blur, latency, judder and the like. These visual aberrations are disadvantageous and can reduce the perceived performance of the augmented reality or virtual reality system for the user. Such visual artifacts can also cause the user to experience undesirable symptoms such as simulator sickness, a motion sickness-like condition.

Previous attempts have been made to address the problem of a close-eye display containing discrepancies of visual artifacts in the visual field that may be caused for example by head and eye movements, including associated camera movements for augmented reality, for example by increasing the frame rate of the whole graphics system. This solution may overly tax resources, such as graphics-processing functions.

There may be many types of visual artifacts in the visual field that may be caused by eye, head, and camera movements. In augmented reality, a camera may take pictures of a room at a rate of 24 frames per second, 30 frames per second or even 60 frames per second. As the camera pans the room the camera takes snapshots of the room. If the camera moves fast enough, the difference in time between each snapshot may be significant and data in between frames may be lost, not captured or distorted.

One type of visual artifact that may be caused by the effects of eye, head, or camera movements is judder effect. This visual artifact may be generated by a method of image acquisition in which each frame may be recorded from a snapshot at a single point in time. Judder effect is perceived when eyes attempt to track a moving object across a display screen which may be captured by a camera panning across the object. Video and film create the illusion of movement by rapidly displaying an object at different discrete locations, some number of times per second. However, a user's eyes essentially track moving objects by moving smoothly. As a result, in systems such as those typically used in video and film, the object's position tends to gradually fall behind where a user's eyes may be looking, and then suddenly may catch up when the new frame appears. In film, frames are captured at 24 times per second, which may be slow enough to create a noticeable feeling of vibration or "judder." The judder effect may be the sudden catch up, sometimes referred to as a jerk, as a new frame appears. This method of video capture may produce distortions of fast-moving objects. The judder effect also can manifest itself when displaying a stationary object, where the display is a close-eye display, such as augmented reality or virtual reality, and where the user's head and/or eye(s) moves. As the frame is displayed for a period of time, typically the frame refresh rate, the user's head and eyes move smoothly, but the image remains fixed for the duration of the frame. This is then followed by a jump as the next frame, which accounts for the user's head movement, is displayed.

Another visual artifact is motion blur. Motion blur can occur when part or all of an image is moving at a rate that is too high for a given image persistence. For example, assuming the refresh rate is synced with the motion, an image moving at 10 pixels/second will have 1 pixel of motion blur if the image persistence is 100 milliseconds. 100 pixels per second of motion would result in 10 pixels of motion blur for such a display. As the persistence is decreased, the display will be able to tolerate a higher rate of movement before the occurrence of motion blur. For example, with a 10 millisecond persistence, there will be 1 pixel of motion blur when the movement reaches 100 pixels/second. Likewise a 1 millisecond persistence can tolerate 1,000 pixels per second of motion before experiencing 1 pixel of motion blur. Full persistence for a 60 frames per second signal translates into 16.7 milliseconds of persistence. Such a display would experience one pixel of motion blur when the motion rate is 60 pixels per second.

Accordingly, it is desirable to address the limitations in the art. This is particularly true for augmented reality and virtual reality, where the movement of the user's head and eyes can cause objects shown on the close-eye display to move rapidly. Thus, there exists a need to provide for systems and methods that may reduce these visual artifacts for rapidly moving objects in particular for close-eye display orientations such as those used in augmented reality or virtual reality applications.

BRIEF DESCRIPTION OF THE DRAWINGS

By way of example, reference will now be made to the accompanying drawings, which are not to scale.

DETAILED DESCRIPTION

Figure 1:
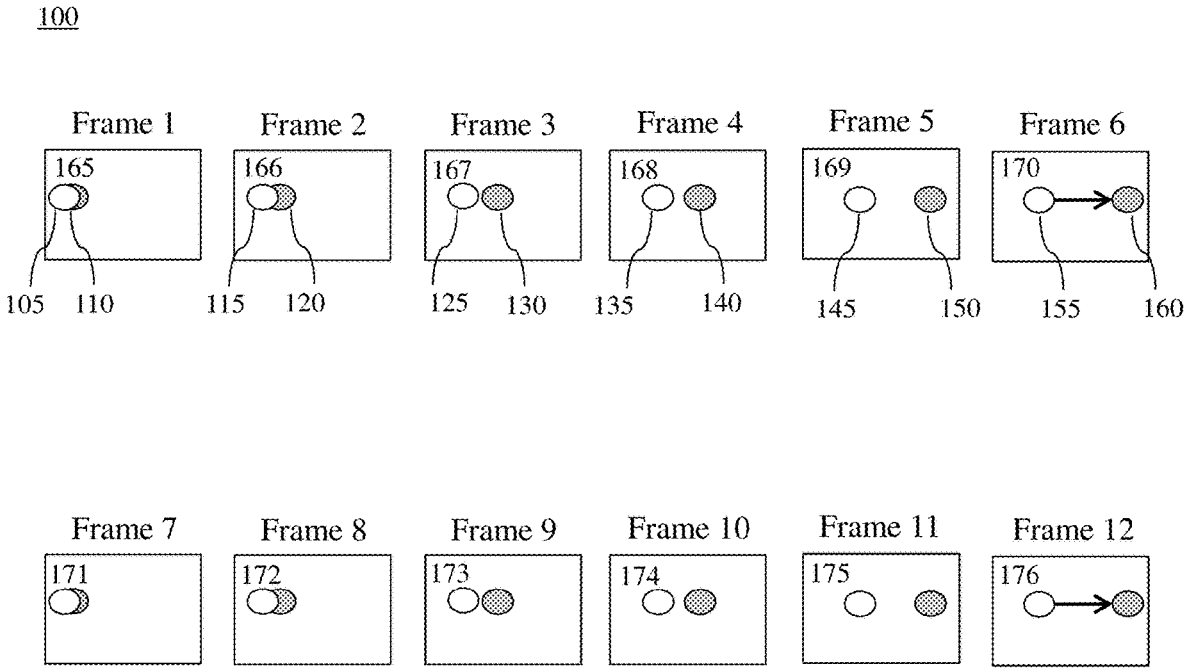
FIG. 1 depicts a display displaying an image moving across a display illustrating the judder effect.

Those of ordinary skill in the art will realize that the following description of the present invention is illustrative only and not in any way limiting. Other embodiments of the invention will readily suggest themselves to such skilled persons, having the benefit of this disclosure. Reference will now be made in detail to specific implementations of the present invention as illustrated in the accompanying drawings. The same reference numbers will be used throughout the drawings and the following description to refer to the same or like parts.

Certain embodiments may set or modify the illumination pulse or duty cycle, which are used interchangeably herein, of an information display (which displays images, text, and the like) on an individual color channel (typically R, G, B) basis. The duty cycles can be set or modified on an individual color channel basis for the entire display, or for one or more groups of one or more pixels of the display. By setting or modifying the duty cycle on an individual color channel basis, display characteristics can be improved, such as brightness, lifetime, or reducing discrepancies of visual artifacts, such as motion blur, latency, judder and the like. Duty cycles can be set or adjusted on an individual color channel basis both for directly-emissive displays, such as organic light emitting diode ("OLED") and micro inorganic light emitting diodes ("ILED") and other directly-emissive display types, and backlit displays, such as LED-backlit liquid crystal displays, and other backlit displays. Setting different duty cycles on an individual color channel basis can be useful both because of differences in the way a user's eye perceives each color channel, and because the emissive characteristics of each color channel may differ, due for example to underlying differences of green, red, and. blue emissive technologies. The duty cycles can be set or adjusted on an individual color channel basis using duty cycle control circuitry and pixel driver. The pixel driver can be configured to provide fixed duty cycles that do not vary on a frame-by-frame or intra-frame basis. Such fixed duty cycles may differ among the individual color channels.

In an RGB (red-green-blue) configuration, a typical user's perceived sharpness is most sensitive to the green color channel. In contrast, a user's perceived sharpness is least sensitive to the blue color channel. The perceived sharpness impact of the red color channel lies between the green and blue color channels. Because of this, improvement in visual artifacts is most sensitive to the green color channel and least sensitive to the blue color channel.

The emissive properties of the technology underlying the information display can vary on a color channel basis. For example, with OLED technology, some OLEDs that emit blue light tend to offer less brightness and/or shorter operating lifetimes than OLEDs that emit green or red light. Accordingly, it may be useful to set a longer duty cycle for the blue color channel as compared to the green or red color channels. Other differences in emissive properties among the color channels, such as different illumination impulse decay rates or profiles, can similarly be considered when setting the duty cycle for a particular color channel. There also may be situations where the emissive properties of the display technology benefit from setting a longer duty cycle for the red or green color channel, for instance.

For a backlit display, such as a Liquid Crystal Display, traditional full spectrum (white) backlighting can be replaced by backlighting with separate color channels, such as red, green, blue color channels. Such a configuration allows the duty cycle for each color channel to be controlled independently of the other color channels. If Light Emitting Diode ("LED") backlighting is used, separate RGB color channels can be available when using separate red, green and blue LEDs (diodes that emit red, green, and blue light respectively). One or more than one of each color LED can be used. The number of LEDs of each color could exceed the number of pixels in the display. The backlight could have the same number of LEDs for each color channel, or the number of LEDs in each color channel could differ.

Use of separate red, green, and blue LEDs is not required. Instead, the backlight could consist of one or more white multicolor LEDs (LEDs that have separate R, G, and B luminance). Similarly, color-specific non-LED backlighting could be used.

Setting or modifying the illumination pulse or duty cycle on a per color channel basis can be accomplished in displays that are globally illuminated, such as a globally backlit display or a directly-emissive display where the entire display is illuminated roughly simultaneously, or in displays that are not globally illuminated, such as a rolling backlight display. Setting or modifying the duty cycle on a per color channel basis can be accomplished in directly-emissive displays that are globally illuminated, where the entire display is illuminated at roughly the same time, and in directly-emissive displays that are not globally illuminated, where only a portion of the display is illuminated at a given time, such as on a rolling basis. In a rolling illumination display, whether backlit or directly-emissive, only a portion of the display is illuminated at a given time, with the illuminated portion often "rolling" from the top of the display to the bottom of the display (or the reverse), or from one side of the display to the other side of the display. While a rolling display is a common type of non-globally illuminated display, setting or modifying the duty cycle on a per color channel basis could likewise be used on other types of non-globally illuminated displays.

Methods and systems are disclosed for avoiding discrepancies of visual artifacts in the visual field or for compensation for discrepancies in an image that may be captured with a moving camera, or may be output from a virtual reality or augmented reality system. The visual artifacts in the visual field may be reduced or eliminated by analyzing the image and comparing it to one or more earlier images, and monitoring head, eye, and camera (if present) movements for a head-mounted display application, and feeding back the movement data to a compensation circuit so that it may eliminate or reduce the visual artifacts such as, motion blur, latency, and judder effect, as the head, eyes, and/or the camera move. The compensation circuit may use the movement data to modify the duty cycle of the display dynamically on an individual color channel basis to eliminate or reduce these visual artifacts. The display's duty cycle may be dynamically controlled on an individual color channel basis at different rates for different head, eye, and camera movement speeds. For a faster camera, eye, or head movements, the duty cycle of the display may need to be shorter to lower the persistence of the imaging system which may reduce the appearance of visual artifacts. Other aspects and advantages of various aspects of the present invention can be seen upon review of the figures and of the detailed description that follows.

In certain embodiments, an image display system is disclosed for compensating for visual artifacts by varying a duty cycle of portions of a display, comprising: a duty cycle calculator for determining at least one duty cycle adjustment for at least one color channel for one group of one or more pixels of a display based at least in part on movement data; and a pixel driver for varying at least one duty cycle for at least one color channel of the at least one group based at least in part on the at least one duty cycle adjustment. The image display system may further comprise a movement sensor for determining the movement data. The movement sensor may comprise: a camera movement sensor; an eye movement sensor; and a head movement sensor. The movement sensor may determine movement data by measuring motion of a user's eyes. The movement sensor may determine movement data by measuring motion of a user's head. The movement sensor may determine movement data by measuring motion of a camera. The movement data may comprise real time movement data. The movement data may comprise predicted movement data. The movement data may comprise real-time data and predicted movement data. The duty cycle may be varied between 0% and 100%. The duty cycle calculator may calculate a plurality of duty cycle adjustments for at least one color channel for a plurality of groups of pixels. The duty cycle calculator may determine a size of the at least one group of pixels. The duty cycle calculator may determine a shape of the at least one group of pixels. The duty cycle calculator may determine a location of the at least one group of pixels.

In certain embodiments, a method is disclosed of compensating for visual artifacts by varying a duty cycle of portions of a display, comprising: determining at least one duty cycle adjustment on an individual color channel basis for at least one color channel for at least one group of one or more pixels of the display based at least in part on movement data; and varying at least one duty cycle of at least one color channel of the at least one group based at least in part on the at least one duty cycle adjustment. The movement data may comprise movement data for a user's eyes. The movement data may comprise movement data for a user's head. The movement data may comprise movement data for a camera. The movement data may comprise real time movement data. The movement data may comprise predicted movement data. The movement data may comprise real-time data and predicted movement data. The duty cycle may be varied between 0% and 100%. The duty cycle calculator may calculate a plurality of duty cycle adjustments on a per color channel basis for at least one color channel for a plurality of groups of one or more pixels. The duty cycle calculator may determine a size of each of the at least one group. The duty cycle calculator may determine a location of the at least one group.

FIG. 1 shows the judder effect 100. FIG. 1 shows an object 105, 115, 125, 135, 145, and 155 moving across the display in sequential frames 165, 166, 167, 168, 169, and 170. The eyes viewpoint 110, 120, 130, 140, 150, and 160 may track a moving object by moving smoothly across the display. The object's position 105, 115, 125, 135, 145, 155 tends to gradually fall behind where a user's eyes may be looking 110, 120, 130, 140, 150, and then suddenly the object 155 may catch up to the eyes' viewpoint 160 when the new frame appears as in frame 6 170. The object 155 suddenly moves to where the eye may be viewing 160, since the object may be captured at frame boundaries which may not be fast enough to keep up with the camera or the head panning the object. The next set of frames 171, 172, 173, 174, 175, and 176 may show that the cycle may repeat itself as the camera, eyes, or head may still be moving.

Figure 2A:
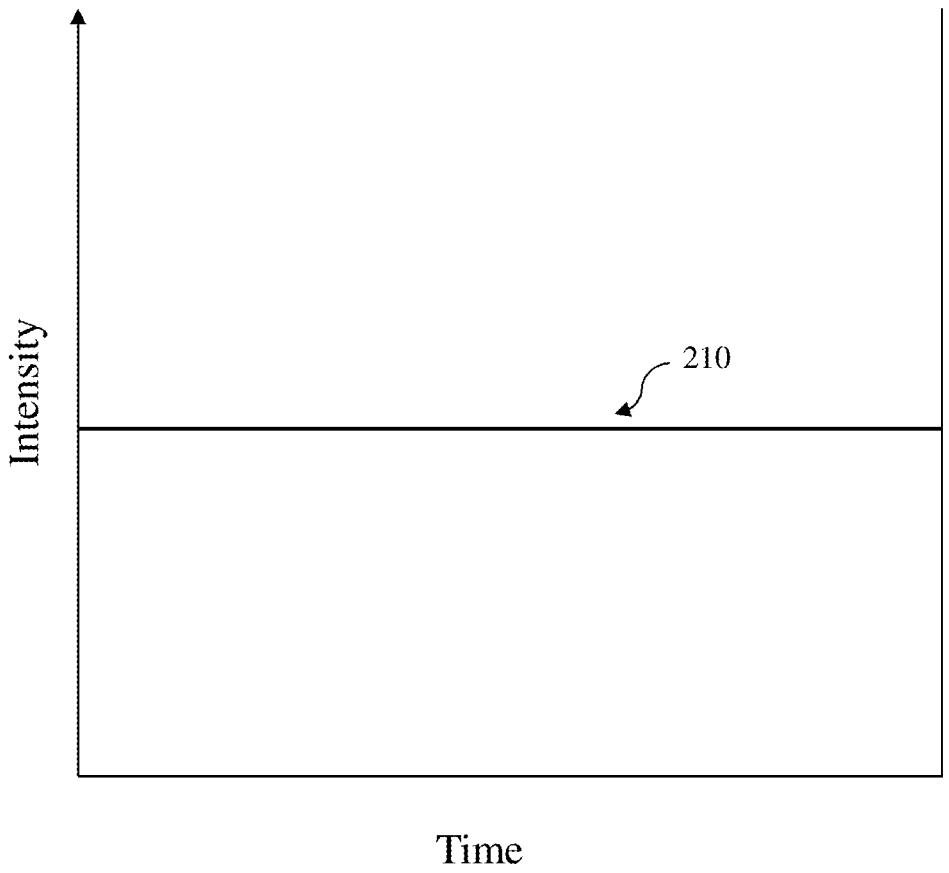
FIG. 2A depicts an example full persistence duty cycle.
Figure 2B:
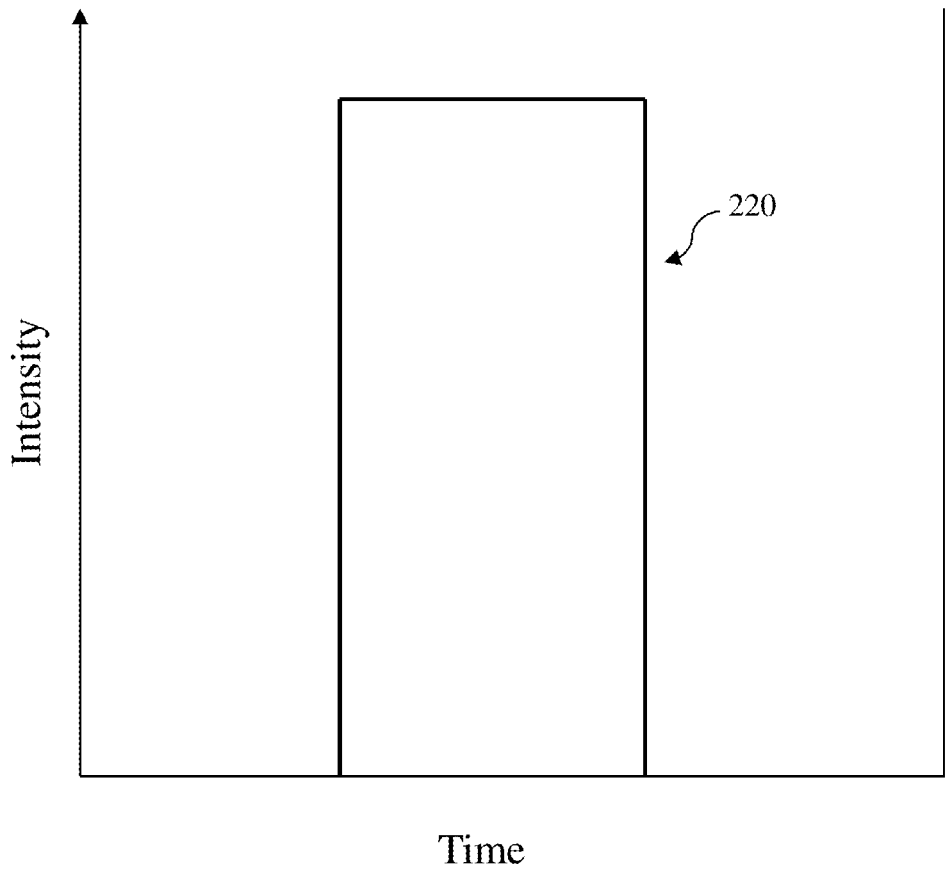
FIG. 2B depicts an example low persistence duty cycle.
Figure 2C:
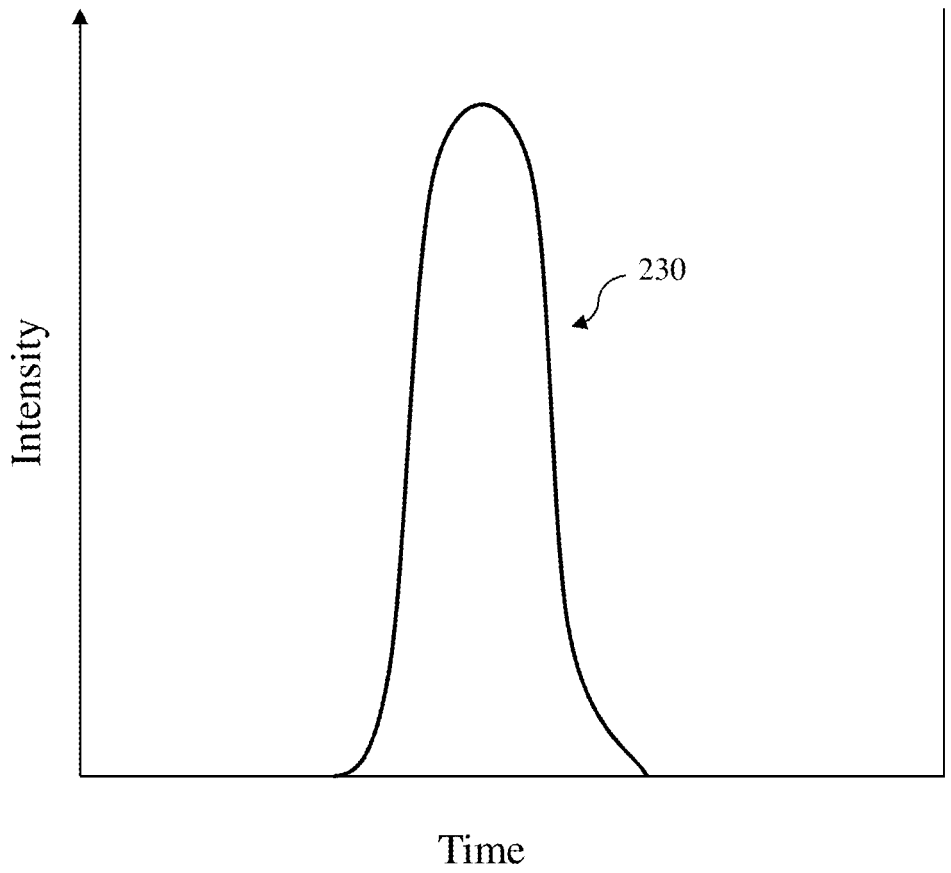
FIG. 2C depicts an example low persistence duty cycle.
Figure 2D:
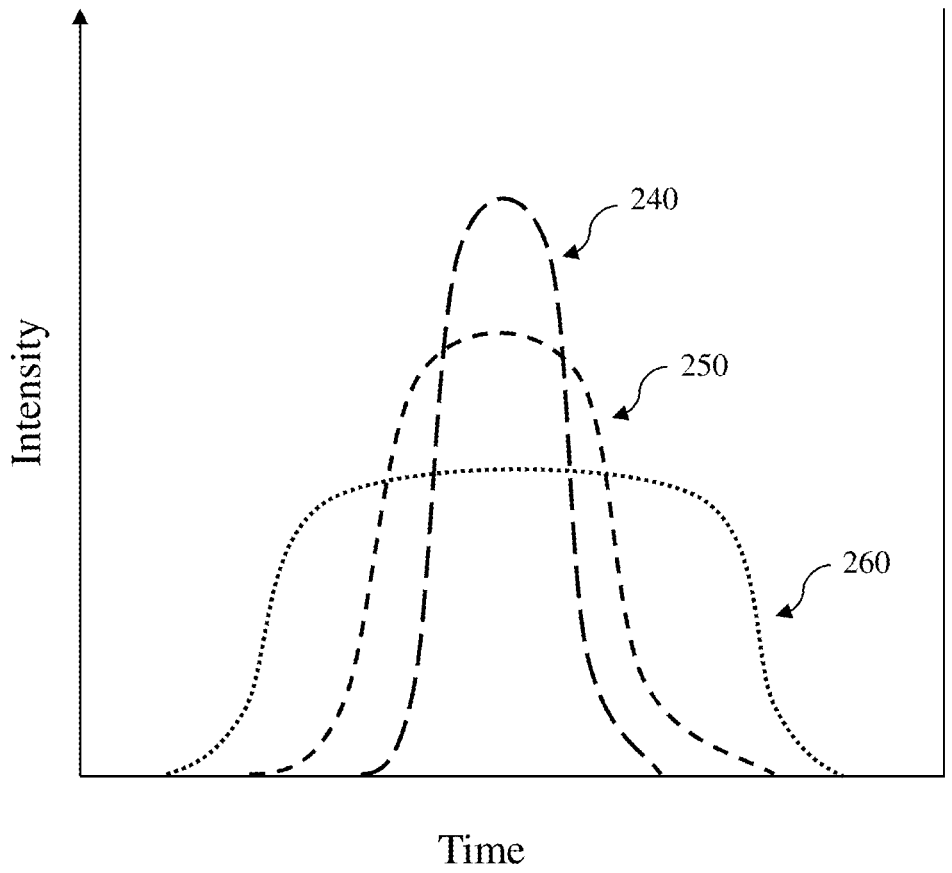
FIG. 2D depicts an example of independent duty cycles for three individual color channels.
Figure 2E:
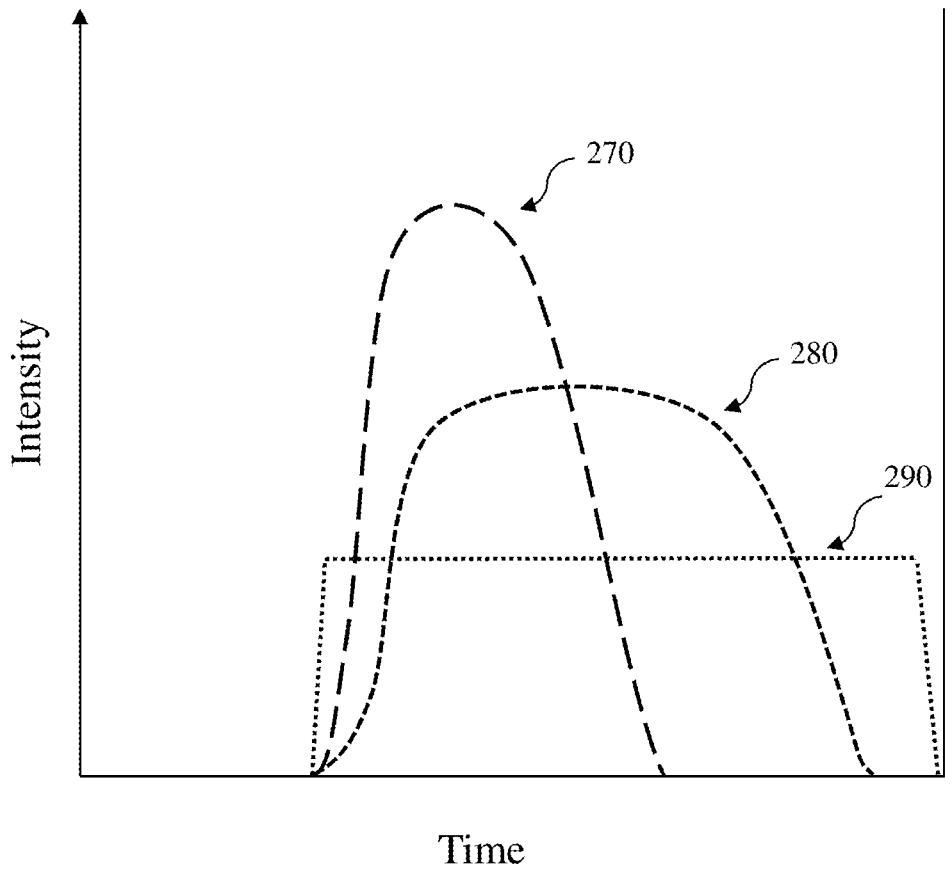
FIG. 2E depicts an example of independent duty cycles for three individual color channels.

FIGS. 2A-E depict example duty cycles or illumination pulses. FIG. 2A is an example of a full persistence duty cycle with the illumination intensity 210 remaining at a constant level for the full duration of the frame. FIG. 2B depicts an example of a low persistence duty cycle, with the illumination intensity 220 beginning at zero at the start of the frame, having a sharp illumination pulse around the middle of the frame, and dropping to zero at the end of the frame. FIG. 2C depicts another low persistence duty cycle. Here, the duty cycle's illumination intensity 230 has a different profile than that of the example in FIG. 2B. FIG. 2D depicts example duty cycles on a per color channel basis. In this example, illumination intensity 240 represents the duty cycle of the green color channel, illumination intensity 250 represents the duty cycle of the red color channel, and illumination intensity 260 represents the duty cycle of the blue channel. These duty cycles could be set in advance, or they could be derived from the Duty Cycle Calculator in response to image data or movement data, or both. These duty cycles could be the duty cycles for one pixel, or a group of pixels, including up to the entire display. FIG. 2E depicts another example of duty cycles on a per color channel basis. In this example, illumination intensity 270 represents the duty cycle of the green color channel, illumination intensity 280 represents the duty cycle of the red color channel, and illumination intensity 290 represents the duty cycle of the blue channel. These duty cycles could be set in advance, or they could be derived from the Duty Cycle Calculator in response to image data or movement data, or both. These duty cycles could be the duty cycles for one pixel, or a group of pixels, including up to the entire display. In FIG. 2E, the duty cycles all begin at approximately the same time within the frame, but end at different times. Depending on the requirements of each particular implementation, duty cycles for each color channel could begin at the same time and end at the same time or at different times, they could begin at different times and end at the same time or at different times, or they could also be centered approximately around the same midpoint. Similarly, the duty cycle of a color channel could last for all or most of the time period, the duty cycle could last for only part of the time period, the duty cycle could last only a small portion of the time period, such as 5-10%, or the duty cycle could last less than 5% of the time period. As shown in FIGS. 2A-E, the duty cycles of the present disclosure have one peak (or impulse) per image frame.

Figure 3:
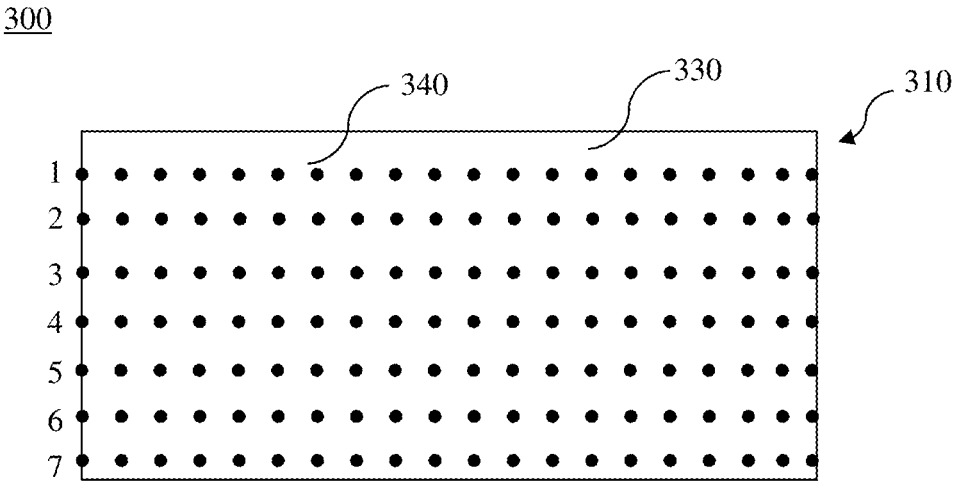
FIG. 3 depicts a view of a display data set with rows of pixels.

In certain embodiments, FIG. 3 depicts a display data set 300 comprising a set of pixels 330 on display 310. The duty cycle for each color channel of each pixel may be controlled individually. For example a pixel 340 may have the duty cycle for each color channel controlled from 0% to 100% depending on what the duty cycle control circuitry specifies to the pixel portion driver. To avoid visual aberrations such as motion blur, latency, judder and the like, in some instances the duty cycle may need to be dynamically adjusted based on current or predicted eye, head, and camera movements. To reduce visual aberrations due to head or eye motion, shorter duty cycles may be applied to one or more color channels to lower the persistence of the imaging system which may reduce motion blur, latency, judder effect and the like. The lowering of the duty cycle may improve the edges of the objects that may be exhibiting visual aberrations.

Certain embodiments may set or modify the duty cycle on an individual color channel basis in a non-globally illuminated display. For example, in a display, whether backlit or directly emissive, where the illumination is rolling (such as vertically or horizontally), the width of the rolling bar can be controlled on an individual color channel basis. For example, the width of the rolling bar for the green color channel may be controlled to be the most narrow, and the rolling bar for the blue color channel may be the widest, with the red color channel set equal to the width of the green or blue color channel, or at a width different than the other two color channels, such as between the two. The width of the rolling bar for each color channel can remain generally constant, or the width of the rolling bar for each color channel can be adjusted for a plurality of frames at once, or on a frame by frame basis. The width of the rolling color bar for a given color channel may be modified for an entire image frame, or the width of the rolling bar may be controlled on a finer basis, for instance on an intra-frame basis. One may wish to set or modify the width of the rolling illumination on an individual color channel basis in an attempt to compensate for differences in the emissive properties of the display on a per color channel basis, such as the differences in emissive properties of a green OLED vs. a red OLED vs. a blue OLED for a directly-emissive display, or the difference between green LED backlighting vs. red LED backlighting vs. blue LED backlighting in a backlit display. One may wish to modify the width of the rolling illumination on an individual color channel basis to mitigate visual aberrations due to camera, eye, or head movement, where a narrower rolling bar may be applied to one or more color channels to lower the persistence of the imaging system, which may reduce motion blur, latency, and judder effect. The narrowing of the rolling bar may improve the edges of the objects that may be exhibiting visual aberrations.

Figure 4:
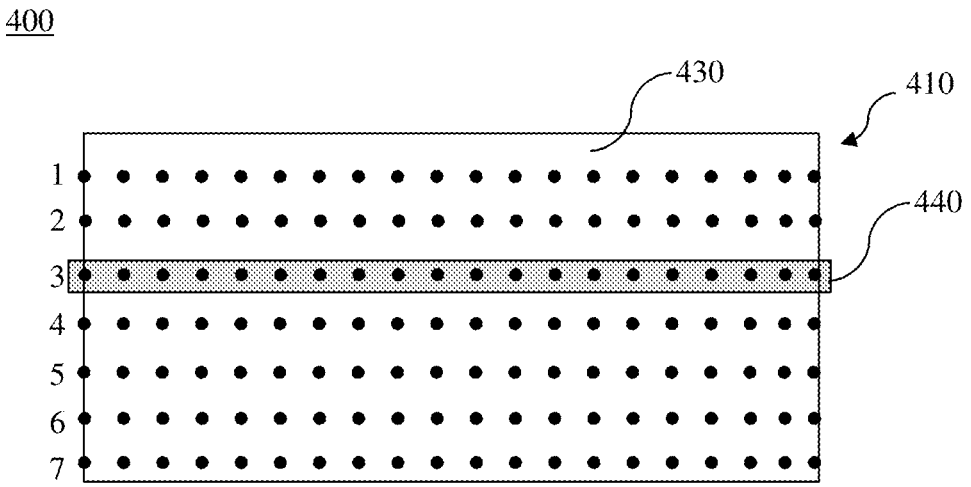
FIG. 4 depicts a view of a line of duty cycle controlled pixels within a display data set in accordance with certain embodiments.

Certain embodiments may set or modify the duty cycle on an individual color channel basis of a line of pixels to mitigate visual artifacts, such as motion blur, latency, and judder effect. In certain embodiments, FIG. 4 depicts a display data set 400 that comprises a display 410 with multiple rows of pixels 430, including a row of pixels 440. The duty cycle of each color channel within each row may be controlled individually. For example a row of pixels 440 may have its duty cycle for each color channel controlled from 0% to 100% depending on what the duty cycle control circuitry specifies to a pixel driver. To reduce visual aberrations such as motion blur, latency, and judder effect, in some instances the duty cycle may need to be dynamically adjusted on an individual color channel basis based on current or predicted eye, head, and camera movements. To mitigate visual aberrations due to camera, eye, or head movement, shorter duty cycles may be applied to one or more color channels to lower the persistence of the imaging system, which may reduce motion blur, latency, and judder effect. The lowering of the duty cycle may improve the edges of the objects that may be exhibiting visual aberrations.

Figure 5:
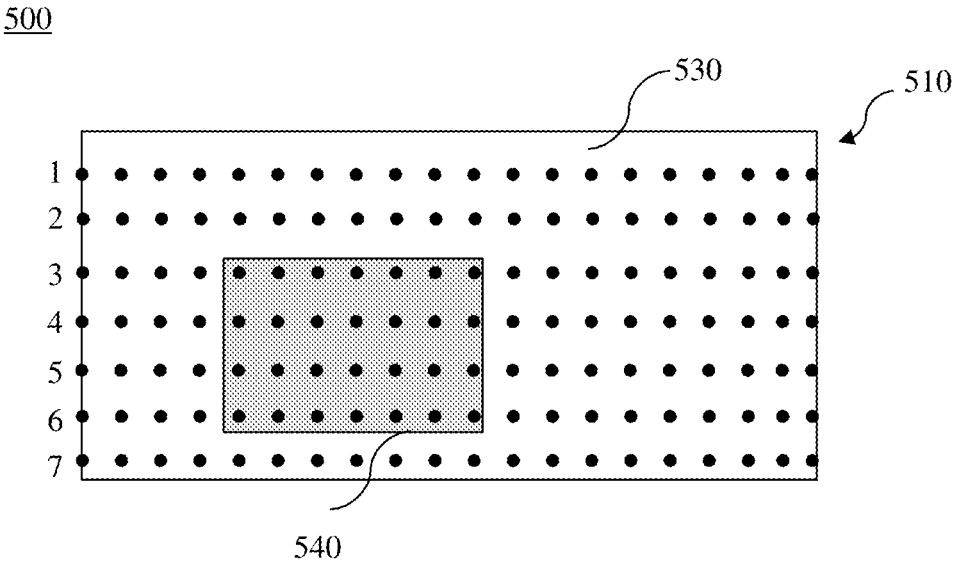
FIG. 5 depicts a view of a portion of duty cycle controlled pixels within a display data set in accordance with certain embodiments.

Certain embodiments may set or modify the duty cycle on an individual color channel basis of a portion of pixels to improve discrepancies of visual artifacts, such as motion blur, latency, and judder effect. In certain embodiments, FIG. 5 depicts a display data set 500 that comprises a display 510 with a set of m by n pixels 530 including one or more groups of pixels, such as group 540 of pixels a by b, where $1 \le a \le m$ and $1 \le b \le n$. In some embodiments, the duty cycle of each color channel of each group of pixels may be controlled individually. For example, group 540 may have its duty cycle for each color channel controlled from 0% to 100% depending on what the duty cycle control circuitry specifies to the pixel driver. To reduce visual aberrations such as motion blur, latency, and judder effect, in some instances the duty cycle may need to be dynamically adjusted on a per color channel basis based on current or predicted head and/or eye movements. To mitigate visual aberrations due to head and eye movements, shorter duty cycles may be applied to one or more color channels to lower the persistence of the imaging system which may reduce motion blur, latency, and judder effect. The lowering of the duty cycle may improve the edges of the objects that may be exhibiting visual aberrations.

Figure 6:
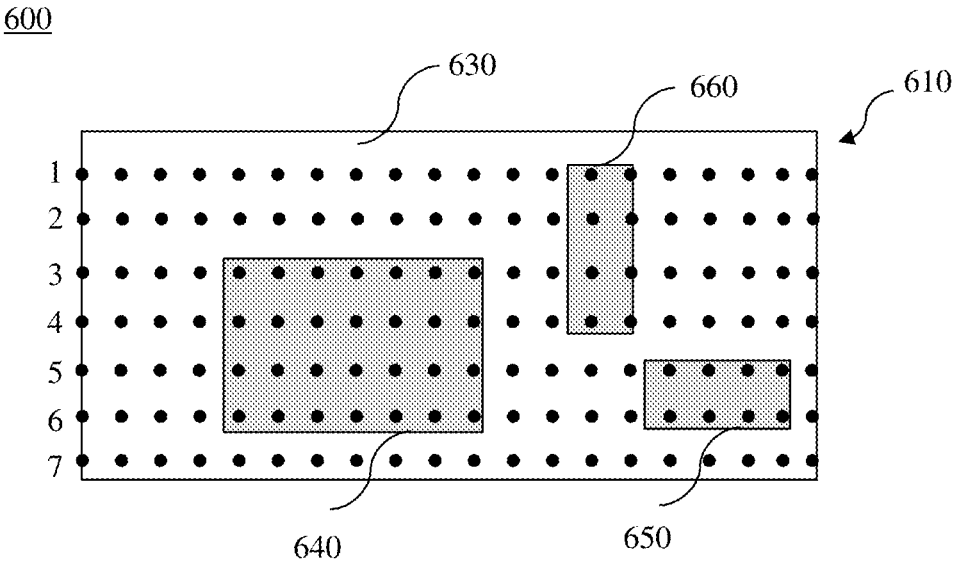
FIG. 6 depicts a view of multiple portions of duty cycle controlled pixels within a display data set in accordance with certain embodiments.

Certain embodiments may modify the duty cycle on an individual per color channel basis of multiple groups of pixels to improve discrepancies of visual artifacts, such as motion blur, latency, and judder effect. In certain embodiments, FIG. 6 depicts a display data set 600 that comprises a display 610 with a set of m by n pixels 630 that includes a first group 640 of pixels a by b, where $1 \le a \le m$ and $1 \le b \le n$, a second group 650 of pixels c by d, where $1 \le c \le m$ and $1 \le d \le n$, and a third group 660 of pixels p by q, where $1 \le p \le m$ and $1 \le q \le n$. Each group 640, 650, and 660 may contain a different set of pixels and have a different shape. The shape of a group of pixels may be any shape such as a square, a rectangle, an approximate circle, or any other non-linear shape as can be approximated. In some embodiments, the duty cycle of each color channel of each group of pixels may be controlled independently of other groups of pixels. For example groups 640, 650, and 660 may each have their duty cycles for each color channel controlled from 0% to 100% depending on what the duty cycle control circuitry specifies to a pixel driver. To reduce visual aberrations, the duty cycle may be dynamically adjusted based on current or predicted head and/or eye movements. To mitigate visual aberrations due to head and eye motion, shorter duty cycles may be applied to one or more color channels to lower the persistence of the imaging system which may reduce motion blur, latency, and judder effect. The lowering of the duty cycle may improve the edges of the objects that may be exhibiting visual aberrations.

Figure 7:
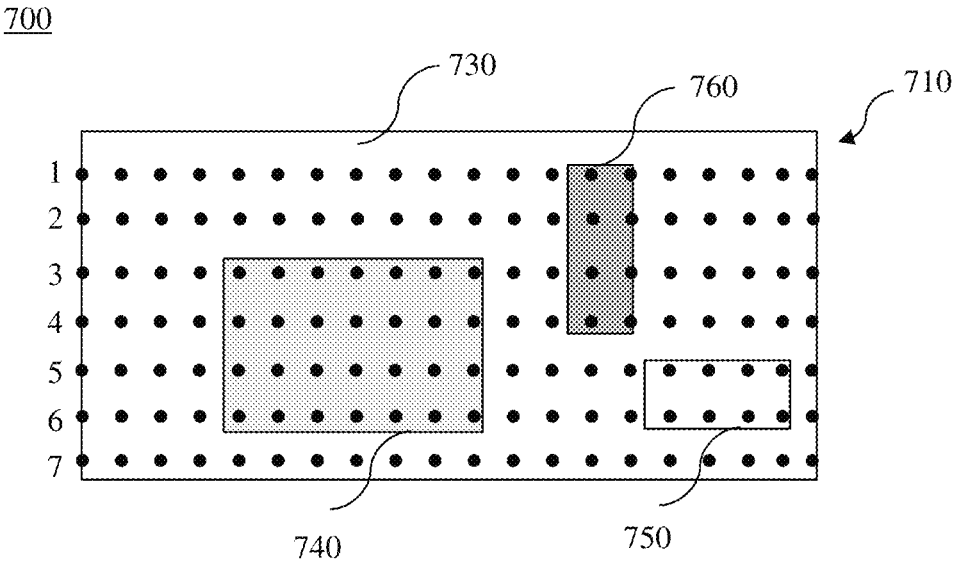
FIG. 7 depicts a view of multiple portions of controlled pixels within a display data set with different duty cycles in accordance with certain embodiments.

In certain embodiments, FIG. 7 depicts a display data set 700 that comprises a display 710 with a set of m by n pixels 730 that includes a first group 740 of pixels a by b, where $1 \le a \le m$ and $1 \le b \le n$, a second group 750 of pixels c by d, where $1 \le c \le m$ and $1 \le d \le n$, and a third group 760 of pixels p by q, where $1 \le p \le m$ and $1 \le q \le n$. Each group 740, 750, and 760 may contain a different set of pixels and have a different shape. Each group 740, 750, and 760 may have a different duty cycle for each color channel depending on what the duty cycle control circuit specifies to the pixel driver for each portion. FIG. 7 illustrates three groups 740, 750, and 760 where each group has a different duty cycle for at least one color channel shown as illustrated by different grey scaling of each group.

Multiple groups and individual pixels may also be intermixed to mitigate localized discrepancies of visual artifacts, such as motion blur, latency, and judder effect. A display data set may contain multiple groups and multiple pixel groupings that may have their respective duty cycles varied on an individual color channel basis independently of one another to mitigate localized visual aberrations. Therefore, it is understood that the invention is not to be limited to the specific embodiments disclosed, and that modifications and embodiments are intended to be included as readily appreciated by those skilled in the art.

Figure 8:
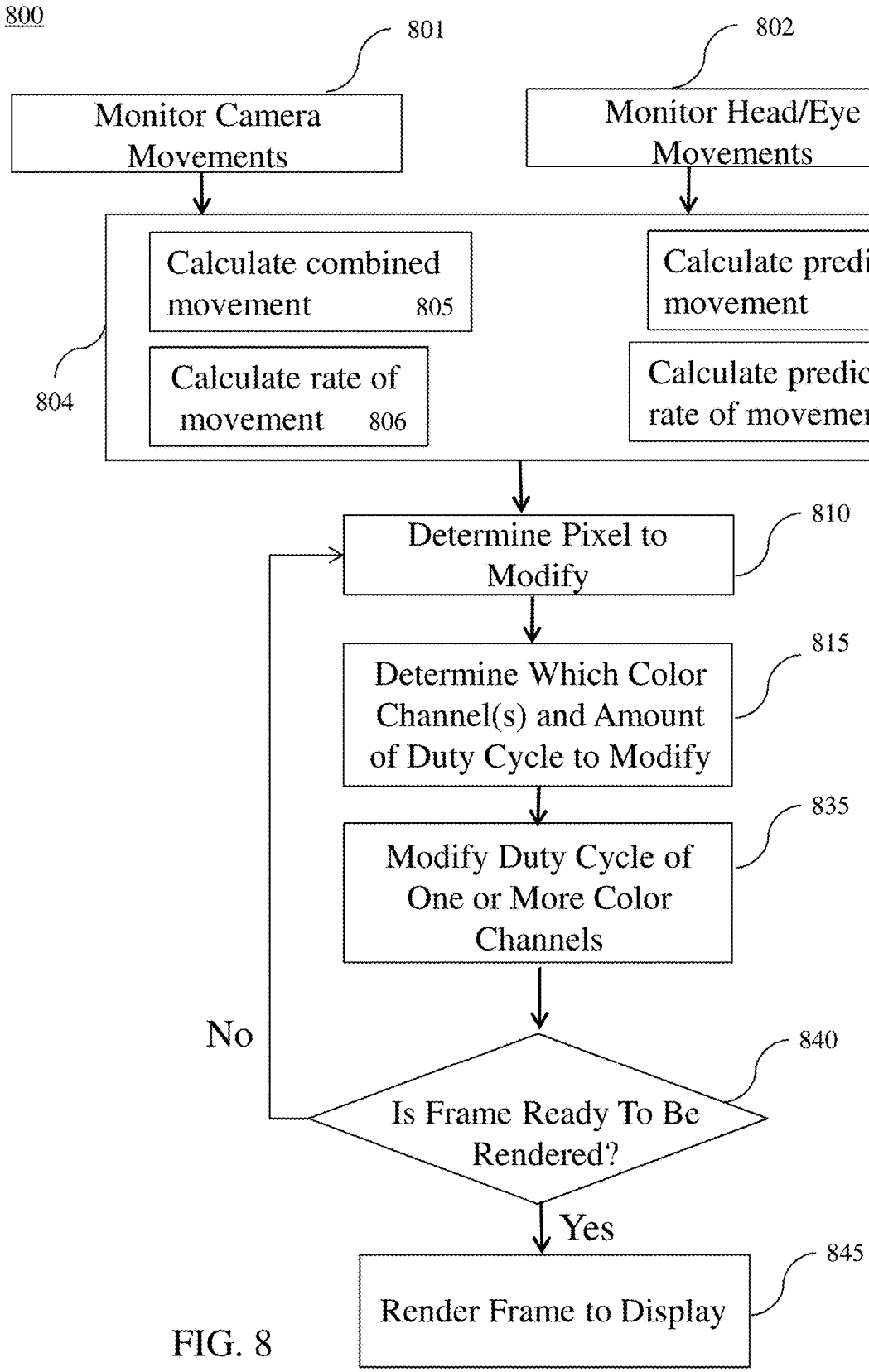
FIG. 8 depicts a flow chart of a method of an image display system varying the duty cycle of pixels of a display data set in accordance with certain embodiments.

In certain embodiments, FIG. 8 illustrates a flow chart of a method 800 for modifying the duty cycle on an individual color channel basis of pixels to mitigate visual artifacts, such as motion blur, latency, and judder effect. The modification of the duty cycle of one or more color channels of a pixel may occur intra-frame, while a frame may be waiting to be rendered to the display. The method may begin by measuring and/or monitoring how much the camera may be moving (801). Movements of the head and eye(s) may also be measured and/or monitored (802). In some embodiments, camera movements and head movements are monitored by devices that may comprise one or more accelerometers that measure how much, in what direction and how quickly the camera and the head respectively move.

Measurements of movements of the head and the camera may be used to calculate a measure of combined real-time movement (805) of the head and the camera. In some embodiments, the measurements further may be used to determine a rate of movement (806). In some embodiments, the measurements of movements of the head, the eyes, and the camera may be input to a prediction algorithm that outputs predicted movements (of head, eyes, and/or camera) (807) and/or a predicted rate of movement (808). In certain embodiments, the predicted movements may be used as an input to block 805 and may be used in calculating the combined movement at 805. In some embodiments, one or more of the combined real-time movement (805), rate of movement (806), predicted movement (807) and the predicted rate of movement (808) are used to modify the duty cycle of at least one color channel of one or more pixels and/or one or more groups of pixels. If the camera or the head moves faster than the frame rate of the camera, then visual artifacts may appear on the display. In certain embodiments, these visual artifacts may be corrected by varying the duty cycle of one or more color channels of one or more pixels and/or one or more groups of pixels to compensate for these movements.

In certain embodiments, the total magnitude of movement and/or the rate of the movements may be then used to calculate the modification of duty cycle on an individual color channel basis of one or more pixels and/or one or more groups of pixels. In certain embodiments, method 800 determines which pixel or pixels to modify (810). A pixel may be selected to have its duty cycle modified on a per color channel basis depending on the combined movement calculation calculated at 805. Determining the amount of duty cycle to modify 815 for a particular pixel may be calculated using the combined movement data. The duty cycle of each color channel may be modified 815 between the range of about 0% to about 100%. In some embodiments, the faster the camera, eyes, or head moves, the shorter the duty cycle of one or more color channels that may be applied to the display so that the image has low persistence. This may reduce motion blur, latency, and judder effect, but may also may decrease the brightness of the display.

The pixel's duty cycle may then be modified (835) on the display. If the frame is not ready to be rendered to the display (840), the modification of the duty cycle on an individual color channel basis of a pixel may continue. The modification of the pixel may also be continuous in between rendering frames to the display 845. The cycle of calculating combined movements 805 of the camera, the eyes, and the head may be continuous and determining which pixel to modify as well as the amount of duty cycle for each color channel to modify may continuously be adapted and changed until a frame is ready to be rendered. The duty cycle for one or more color channels may be modified to offset the camera, eye, and head movements to mitigate visual artifacts, such as motion blur, latency, and judder effect, in the visual field. After the frame is rendered, the process may start over with the next frame of data to be displayed.

Figure 9:
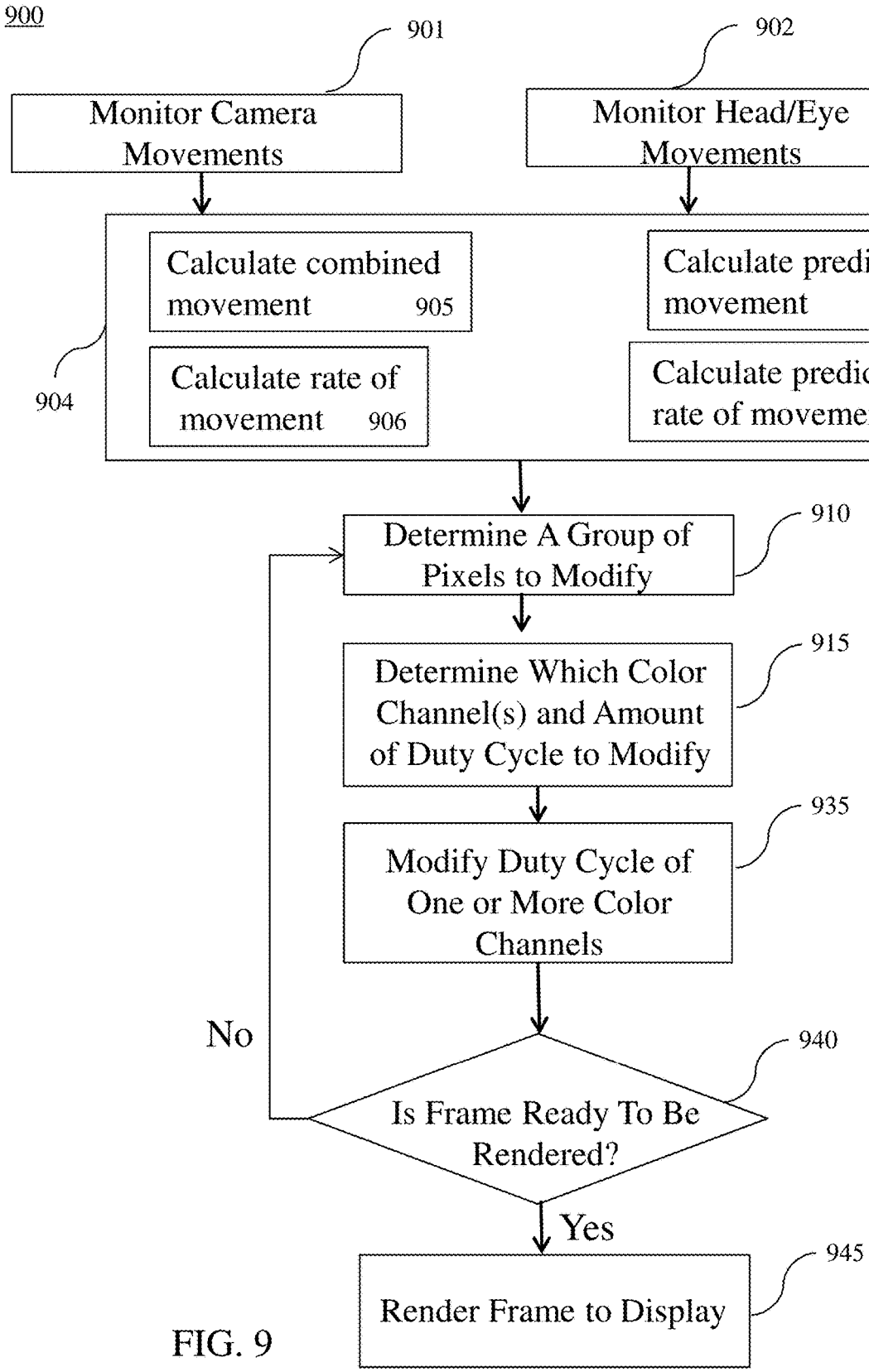
FIG. 9 depicts a flow chart of a method of an image display system varying the duty cycle of portions of a display data set in accordance with certain embodiments.

In certain embodiments, FIG. 9 illustrates a flow chart of a method 900 for modifying the duty cycle on an individual color channel basis of a group of pixels, such as row 440 or group 540 in order to mitigate discrepancies of visual artifacts, such as motion blur, latency, and judder effect. The modification of duty cycle of one or more color channels of the group of pixels may occur intra-frame while a frame may be waiting to be rendered to the display.

Method 900 is similar to method 800, except that duty cycle for a group of pixels is modified (910) on an individual color channel basis within the display pixels. When the group is a 1 by 1 matrix, then it becomes the case discussed with reference to FIG. 8. The amount of the duty cycle modification 915 to be performed to the group of pixels may be between the range of 0% to 100%. The duty cycle of one or more color channels of the group of pixels may then be modified (935). If the frame is not ready to be rendered to the display (940), the modification of the duty cycle of the one or more color channels of the group of pixels may continue. The modification of the group of pixels may also be continuous in between rendering frames. The cycle of calculating combined movements of the camera, eyes, and the head may be continuous and determining which portion of pixels to modify as well as which color channels and the amount of duty cycle to modify may continuously be updated and changed while a frame is waiting to be rendered. The duty cycle may be modified to offset the camera, eye, and head movements to mitigate visual artifacts, such as judder effect, in the visual field. After the frame is rendered, the process may start over with the next display frame of data as the method is described here.

Figure 10:
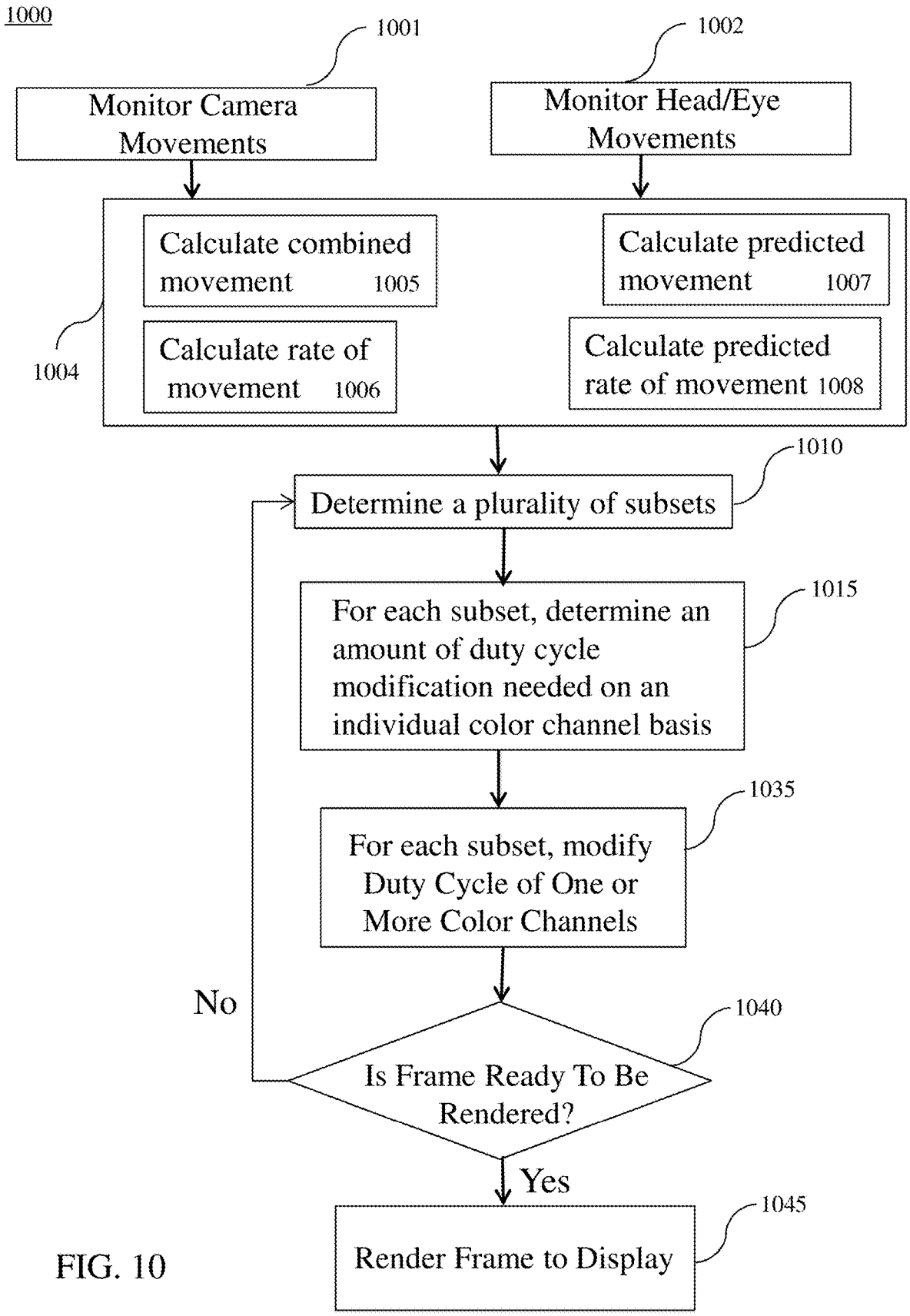
FIG. 10 depicts a flow chart of the method of an image display system varying the duty cycle of multiple portions of a display data set in accordance with certain embodiments.

FIG. 10 illustrates a flow chart of a method 1000 for modifying the duty cycle on a per color channel basis of multiple groups of pixels, such as groups 640, 650 and 660. As discussed above with reference to FIG. 6, a set of m by n pixels 630 may include a first group 640 of pixels a by b, where $1 \leq a \leq m$ and $1 \leq b \leq n$, a second group 650 of pixels c by d, where $1 \leq c \leq m$ and $1 \leq d \leq n$, and a third group 660 of pixels p by q, where $1 \leq p \leq m$ and $1 \leq q \leq n$. Method 900 may function, to mitigate visual artifacts, such as motion blur, latency, and judder effect, in the visual field. While the exemplary groups illustrated in FIG. 6 are rectangular in shape, the groups may assume various shapes, such as square (a special case of a rectangle), an approximate circle (a plurality of rectangles), etc.

In certain embodiments, the modification of duty cycle on a per color channel basis of multiple groups of pixels may occur intra-frame while a frame may be waiting to be rendered to the display. Method 1000 is similar to method 800, except that duty cycle for one or more color channels for a plurality of groups of pixels is modified (1010) within the display. Each of the plurality of groups of pixels may be controlled independently of one another. In some embodiments, the modification of duty cycle of one or more color channels of the plurality of groups of pixels happens in parallel. Alternately, depending on processing power, etc. and in other embodiments, the modification may be performed in serial. The duty cycle of one or more color channels for different sections of a display may be controlled by controlling the respective color channel duty cycles of different groups of pixels. For each group, the amount of duty cycle to be modified is determined (1015) on an individual color channel basis. The amount of the duty cycle may be modified 1015 between the range of about 0% to about 100%. Each of the multiple groups of pixels may have different individual color channel duty cycles, for example and without limitation, one group of pixels (e.g. group 640) may have a green color channel duty cycle of 25% while another group (e.g., group 650) may have a green color channel duty cycle of 75%. In addition, the duty cycles of the individual color channels for a particular pixel or group of pixels may vary from each other. Duty cycle modification of the groups of pixels may continue until completed for each group of pixels. If the frame is not ready to be rendered to the display (1040), the modification of the duty cycle for the plurality of groups of pixels may continue. The modification of multiple groups of pixels may also be continuous in between rendering frames (1045). The cycle of calculating combined movements of the camera and the head (at blocks 1004-1008) may be continuous and the determination of which groups of pixels to modify as well as the amount of duty cycle to modify on each group of pixels may be continuously updated and changed while a frame may be waiting to be rendered. The duty cycles may be modified to offset the camera, eye, and head movements to mitigate visual artifacts, such as motion blur, latency, and judder effect, in a visual field. After the frame is rendered, the process may repeat with the next display frame of data as described herein.

Figure 11:
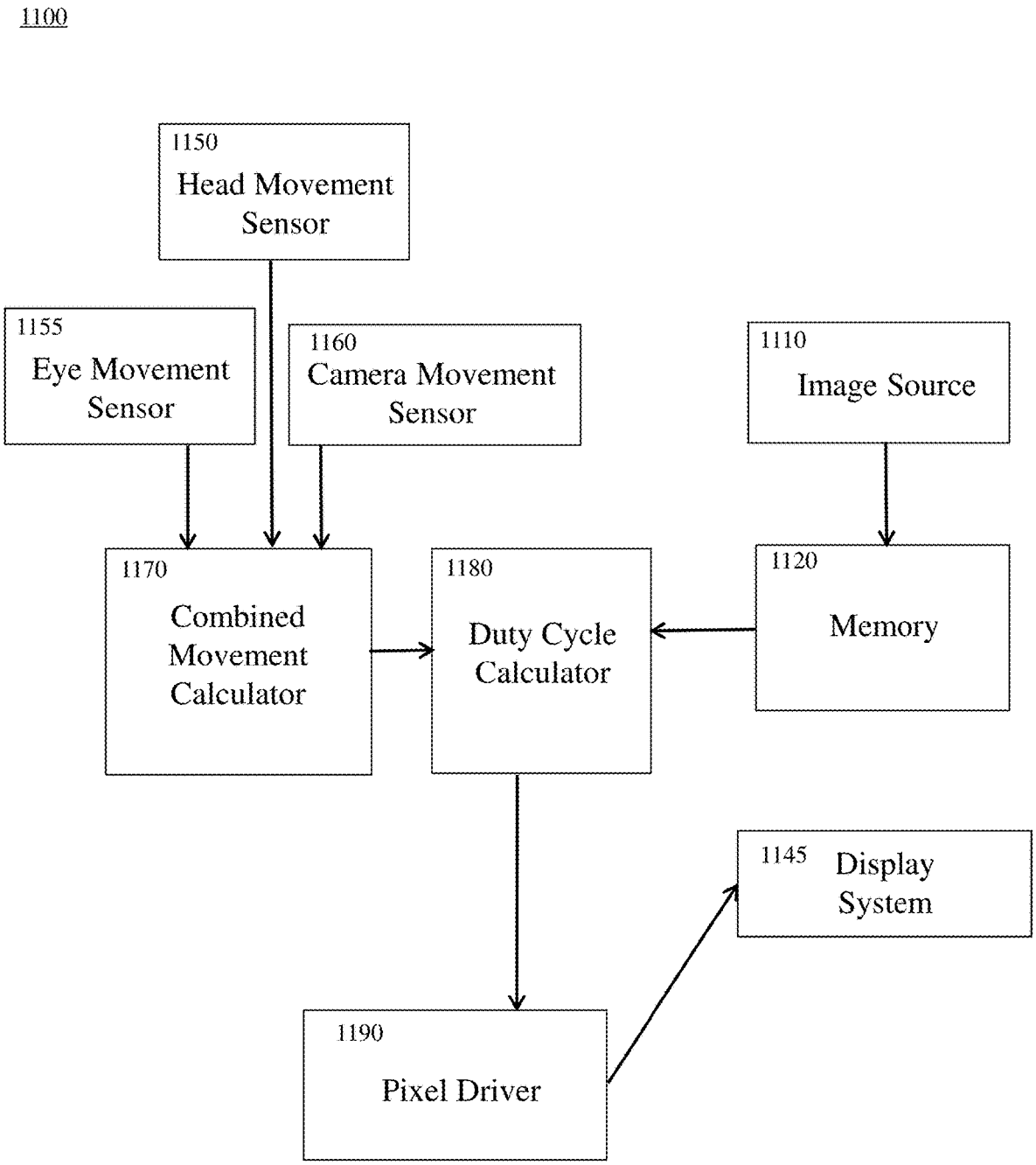
FIG. 11 depicts a block diagram of operation of an image display system that varies the duty cycle of subsets of a display data set in accordance with certain embodiments.

In certain embodiments, the block diagram of FIG. 11 may depict a system 1100 of varying the duty cycle on an individual color channel basis of at least one color channel of one or more pixels on a display, to mitigate visual artifacts, such as motion blur, latency, and judder effect. Image Source device 1110 provides the image to be displayed, which may include image data from a camera, or which may include image data from a virtual reality or augmented reality system, which may be input to memory 1120 (e.g., a cache, or a buffer), e.g., in real-time. Memory 1120 may contain image data for one or more previous images. A Head Movement Sensor 1150 may measure the head movements of a user of a head-mounted display. Head Movement Sensor 1150 may include without limitation one or more accelerometers that may measure how much, in what direction and how quickly the head moves. Eye Movement Sensor 1155 may measure the movement of the user's eye(s). Camera Movement Sensor 1160 may measure the camera movements of a camera, if present, mounted to a head-mounted display. Camera Movement Sensor 1160 may include without limitation one or more accelerometers that measures how much, in what direction and how quickly the camera moves. Head Movement Sensor 1150, Eye Movement Sensor 1155, and Camera Movement Sensor 1160 provide their respective measurements to the Combined Movement Calculator 1170. Combined Movement Calculator 1170 may combine some or all of these measurements to obtain a total vector of movement of the head, eye, and camera combined. The total vector may be calculated from the head, eye, and camera measurements, predicted movements, or a combination of both. The total vector may be composed of the components of the direction, magnitude, and acceleration of the movement of the head, eye, and camera. Output from Combined Movement Calculator is input to Duty Cycle Calculator 1180. Duty Cycle Calculator 1180 may use the total vector or other movement data, and image data from Memory 1120, including image data from one or more previous images, to select the number of groups of pixels that need their duty cycle varied, select the size of each group, select which color channels and the amount of duty cycle to be modified, and select the location of each group. Note that the single pixel method described with reference to FIG. 8 refers to the particular case when the number of groups of pixels that need their duty cycle varied is one, and the size of that group is 1 pixel. Note that the single group method described with reference to FIG. 9 refers to the particular case when the number of groups of pixels that need their duty cycle varied is one, and the size of that group is a matrix greater than 1 by 1. A group of pixels may comprise the entire display.

In certain embodiments, Duty Cycle Calculator 1180 includes a compensation circuit that calculates the amount of duty cycle adjustment for each of one or more color channels for each of the pixels or groups of pixels to compensate for visual artifacts in the visual field. Duty Cycle Calculator 1180 may be connected to Pixel Driver 1190, which varies the duty cycle for one or more color channels of the pixels or groups of pixels on the current frame on the display. Pixel Driver 1190 communicates duty cycles to the Display System 1145, which displays images to a user. For backlit displays, such as LCDs, Display System 1145 may comprise a backlighting emitter, which itself may comprise one or more light sources (such as LEDs) per color channel. For directly-emissive displays such as OLED and ILED, Display System 1145 may comprise directly-emissive pixels. The next frame may be processed in the same manner as described above.

Further, certain figures in this specification are flow charts illustrating methods and systems. It will be understood that each block of these flow charts, and combinations of blocks in these flow charts, may be implemented by computer program instructions. These computer program instructions may be loaded onto a computer or other programmable apparatus to produce a machine, such that the instructions which execute on the computer or other programmable apparatus create structures for implementing the functions specified in the flow chart block or blocks. These computer program instructions may also be stored in a computer-readable memory that can direct a computer or other programmable apparatus to function in a particular manner, such that the instructions stored in the computer-readable memory produce an article of manufacture including instruction structures that implement the function specified in the flow chart block or blocks. The computer program instructions may also be loaded onto a computer or other programmable apparatus to cause a series of operational steps to be performed on the computer or other programmable apparatus to produce a computer implemented process such that the instructions that execute on the computer or other programmable apparatus provide steps for implementing the functions specified in the flow chart block or blocks.

Accordingly, blocks of the flow charts support combinations of structures for performing the specified functions and combinations of steps for performing the specified functions. It will also be understood that each block of the flow charts, and combinations of blocks in the flow charts, can be implemented by special purpose hardware-based computer systems which perform the specified functions or steps, or combinations of special purpose hardware and computer instructions.

For example, any number of computer programming languages, such as C, C++, C# (CSharp), Perl, Ada, Python, Pascal, SmallTalk, FORTRAN, assembly language, and the like, may be used to implement aspects of the present invention. Further, various programming approaches such as procedural, object-oriented or artificial intelligence techniques may be employed, depending on the requirements of each particular implementation. Compiler programs and/or virtual machine programs executed by computer systems generally translate higher level programming languages to generate sets of machine instructions that may be executed by one or more processors to perform a programmed function or set of functions.

The term "machine-readable medium" should be understood to include any structure that participates in providing data which may be read by an element of a computer system. Such a medium may take many forms, including but not limited to, non-volatile media, volatile media, and transmission media. Non-volatile media include, for example, optical or magnetic disks and other persistent memory. Volatile media include dynamic random access memory (DRAM) and/or static random access memory (SRAM). Transmission media include cables, wires, and fibers, including the wires that comprise a system bus coupled to processor. Common forms of machine-readable media include, for example, a floppy disk, a flexible disk, a hard disk, a magnetic tape, any other magnetic medium, a CD-ROM, a DVD, any other optical medium.

Figure 12A:
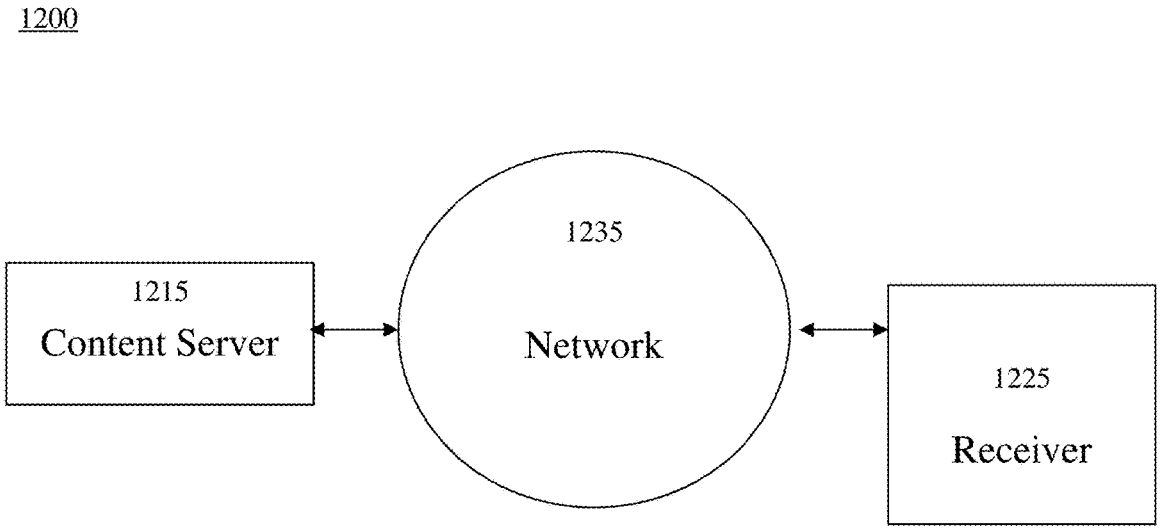
FIG. 12A illustrates an exemplary networked environment and its relevant components according to certain embodiments.

FIG. 12A depicts an exemplary networked environment 1200 in which systems and methods, consistent with exemplary embodiments, may be implemented. As illustrated, networked environment 1200 may include a content server 1215, a receiver 1225, and a network 1235. The exemplary simplified number of content servers 1215, receivers 1225, and networks 1235 illustrated in FIG. 12A can be modified as appropriate in a particular implementation. In practice, there may be additional content servers 1215, receivers 1225, and/or networks 1235.

In certain embodiments, a receiver 1225 may include any suitable form of multimedia playback device, including, without limitation, a cable or satellite television set-top box, a DVD player, a digital video recorder (DVR), or a digital audio/video stream receiver, decoder, and player. A receiver 1225 may connect to network 1235 via wired and/or wireless connections, and thereby communicate or become coupled with content server 1215, either directly or indirectly. Alternatively, receiver 1225 may be associated with content server 1215 through any suitable tangible computer-readable media or data storage device (such as a disk drive, CD-ROM, DVD, or the like), data stream, file, or communication channel.

Network 1235 may include one or more networks of any type, including a Public Land Mobile Network (PLMN), a telephone network (e.g., a Public Switched Telephone Network (PSTN) and/or a wireless network), a local area network (LAN), a metropolitan area network (MAN), a wide area network (WAN), an Internet Protocol Multimedia Subsystem (IMS) network, a private network, the Internet, an intranet, and/or another type of suitable network, depending on the requirements of each particular implementation.

One or more components of networked environment 1200 may perform one or more of the tasks described as being performed by one or more other components of networked environment 1200.

Figure 12B:
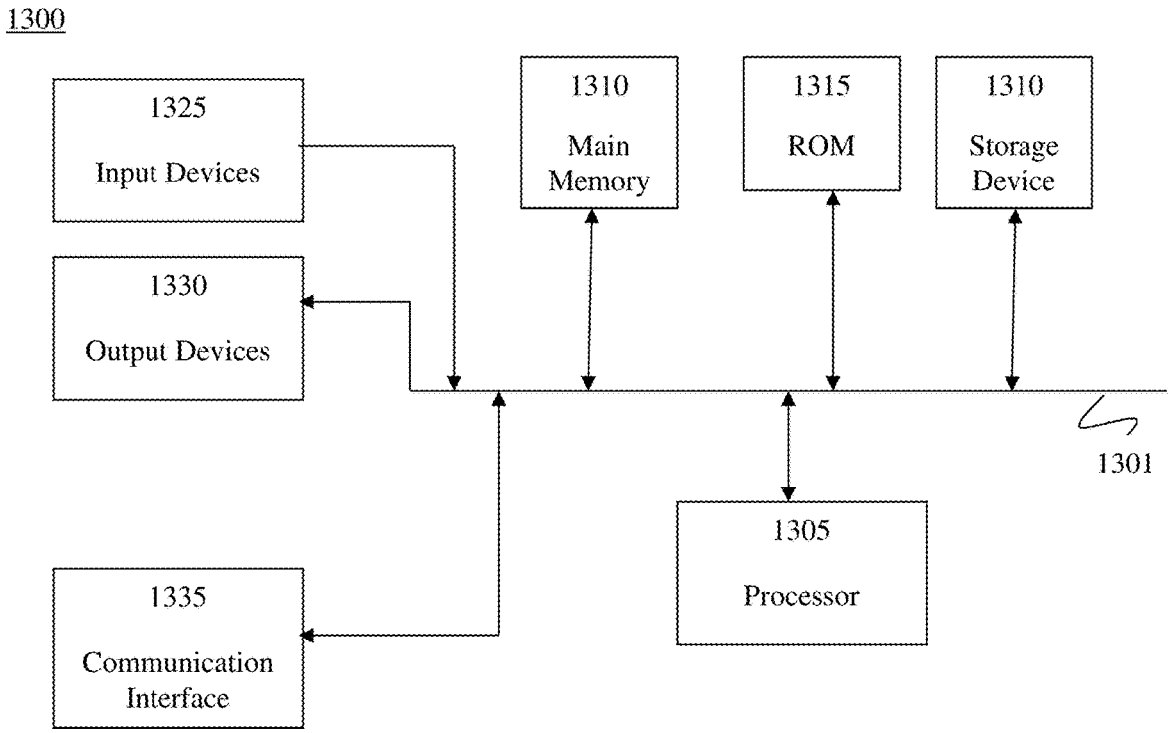
FIG. 12B is an exemplary block diagram of a computing device that may be used to implement certain embodiments.

FIG. 12B is an exemplary diagram of a computing device 1300 that may be used to implement aspects of certain embodiments of the present invention, such as aspects of content server 1215 or of receiver 1225. Computing device 1300 may include a bus 1301, one or more processors 1305, a main memory 1310, a read-only memory (ROM) 1315, a storage device 1320, one or more input devices 1325, one or more output devices 1330, and a communication interface 1335. Bus 1301 may include one or more conductors that permit communication among the components of computing device 1300.

Processor 1305 may include any type of conventional processor, microprocessor, or processing logic that interprets and executes instructions. Main memory 1310 may include a random-access memory (RAM) or another type of dynamic storage device that stores information and instructions for execution by processor 1305. ROM 1315 may include a conventional ROM device or another type of static storage device that stores static information and instructions for use by processor 1305. Storage device 1320 may include a magnetic and/or optical recording medium and its corresponding drive.

Input device(s) 1325 may include one or more conventional mechanisms that permit a user to input information to computing device 1300, such as a keyboard, a mouse, a pen, a stylus, handwriting recognition, voice recognition, biometric mechanisms, and the like. Output device(s) 1330 may include one or more conventional mechanisms that output information to the user, including a display, a projector, an A/V receiver, a printer, a speaker, and the like. Communication interface 1335 may include any transceiver-like mechanism that enables computing device/server 1300 to communicate with other devices and/or systems. For example, communication interface 1335 may include mechanisms for communicating with another device or system via a network, such as network 1235 as shown in FIG. 12A.

In certain embodiments, computing device 1300 may perform operations based on software instructions that may be read into memory 1310 from another computer-readable medium, such as data storage device 1320, or from another device via communication interface 1335. The software instructions contained in memory 1310 cause processor 1305 to perform processes that will be described later. Alternatively, hardwired circuitry may be used in place of or in combination with software instructions to implement processes consistent with the present invention. Thus, various implementations are not limited to any specific combination of hardware circuitry and software.

A web browser comprising a web browser user interface may be used to display information (such as textual and graphical information) on the computing device 1300. The web browser may comprise any type of visual display capable of displaying information received via the network 1235 shown in FIG. 12A, such as Microsoft's Internet Explorer browser, Netscape's Navigator browser, Mozilla's Firefox browser, PalmSource's Web Browser, Google's Chrome browser or any other commercially available or customized browsing or other application software capable of communicating with network 1235. The computing device 1300 may also include a browser assistant. The browser assistant may include a plug-in, an applet, a dynamic link library (DLL), or a similar executable object or process. Further, the browser assistant may be a toolbar, software button, or menu that provides an extension to the web browser. Alternatively, the browser assistant may be a part of the web browser, in which case the browser would implement the functionality of the browser assistant.

The browser and/or the browser assistant may act as an intermediary between the user and the computing device 1300 and/or the network 1235. For example, source data or other information received from devices connected to the network 1235 may be output via the browser. Also, both the browser and the browser assistant are capable of performing operations on the received source information prior to outputting the source information. Further, the browser and/or the browser assistant may receive user input and transmit the inputted data to devices connected to network 1235.

Similarly, certain embodiments of the present invention described herein are discussed in the context of the global data communication network commonly referred to as the Internet. Those skilled in the art will realize that embodiments of the present invention may use any other suitable data communication network, including without limitation direct point-to-point data communication systems, dial-up networks, personal or corporate Intranets, proprietary networks, or combinations of any of these with or without connections to the Internet.

There may be other combinations not presented here. Therefore, it is understood that the invention is not to be limited to the specific embodiments disclosed, and that modifications and embodiments are intended to be included as readily appreciated by those skilled in the art.

While the above description contains many specifics and certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art, as mentioned above. The invention includes any combination or subcombination of the elements from the different species and/or embodiments disclosed herein.

We claim:

1. An information display system comprising:

a backlighting emitter comprising a plurality of color channels;

a duty cycle calculator configured to:

receive movement data associated with a user of said information display system;

receive image data comprising an image to be analyzed and one or more earlier images;

analyze the image to be analyzed, including comparing the image to the one or more earlier images; and determine at least one duty cycle adjustment for at least one of said color channels for one group of one or more pixels of said information display system based at least in part on the received movement data and the analysis of the image, the duty cycle adjustment indicating a first duty cycle for the at least one of said color channels and a second duty cycle for another of said color channels, wherein the first duty cycle is different from the second duty cycle; and a pixel driver coupled to the backlighting emitter and the duty cycle calculator, the pixel driver configured to vary the respective duty cycles of said plurality of color channels based at least in part on said determined duty cycle adjustment.

2. The information display system of claim 1, wherein said plurality of color channels comprises a green color channel, a red color channel, and a blue color channel.

3. The information display system of claim 2, where the information display is a close-eye display.

4. The information display system of claim 2, wherein said backlighting emitter comprises a plurality of light sources per said color channel.

5. The information display system of claim 1, wherein one of said plurality of color channels is a blue color channel, and the duty cycle of said blue color channel is set by said duty cycle adjustment to be longer in duration than the duty cycle of at least one other color channel.

6. The information display system of claim 1, wherein one of said plurality of color channels is a green color channel, and the duty cycle of said green color channel is set by said duty cycle adjustment to be shorter in duration than the duty cycle of at least one other color channel.

7. An information display system comprising:

a rolling backlighting emitter bar comprising a plurality of color channels; and a processor configured to selectively control a width of the rolling backlighting generated by said backlighting emitter bar on an individual color basis, such that the width of the rolling backlighting emitter bar for one of said color channels is controlled to be different from the width of the rolling backlighting generated by said backlighting emitter bar for another of said color channels.

8. The information display system of claim 7, wherein said plurality of color channels comprises a green color channel and a blue color channel, and the width of the rolling backlighting generated by said backlighting emitter bar for said green color channel is controlled to be narrower than the width of the rolling backlighting generated by said backlighting emitter bar for said blue color channel.

9. An information display system comprising:

a plurality of directly-emissive pixels having a plurality of color channels;

a duty cycle calculator configured to:

receive movement data associated with a user of said information display system;

receive image data comprising an image to be analyzed and one or more earlier images;

analyze the image to be analyzed, including comparing the image to the one or more earlier images; and determine at least one duty cycle adjustment for at least one of said color channels for one group of one or more pixels of said information display system based at least in part on the received movement data and the analysis of the image, the duty cycle adjustment indicating a first duty cycle for the at least one of said color channels and a second duty cycle for another of said color channels, wherein the first duty cycle is different from the second duty cycle; and a pixel driver coupled to the plurality of directly-emissive pixels and the duty cycle calculator, the pixel driver configured to vary the respective duty cycles of said plurality of color channels based at least in part on said determined duty cycle adjustment.

10. The information display system of claim 9, wherein said plurality of color channels comprises a green color channel, a red color channel, and a blue color channel.

11. The information display system of claim 10, where the information display is a close-eye display.

12. The information display system of claim 9, wherein one of said plurality of color channels is a blue color channel, and the duty cycle of said blue color channel is set by said duty cycle adjustment to be longer in duration than the duty cycle of at least one other color channel.

13. The information display system of claim 9, wherein one of said plurality of color channels is a green color channel, and the duty cycle of said green color channel is set by said duty cycle adjustment to be shorter in duration than the duty cycle of at least one other color channel.

14. An information display system comprising:

a plurality of directly-emissive pixels having a plurality of color channels; and a processor configured to selectively control said pixels to be illuminated on a rolling basis, wherein the processor selectively controls the width of said rolling illumination for one of said color channels to be different from the width of said rolling illumination for another of said color channels.

15. The information display system of claim 14, wherein said plurality of color channels comprises a green color channel and a blue color channel, and the width of said rolling illumination for said green color channel is controlled to be narrower than the width of said rolling illumination for said blue color channel.

16. An information display system for compensating for visual artifacts, comprising:

a plurality of color channels;

a duty cycle calculator configured to:

receive movement data associated with a user of said information display system;

receive image data comprising an image to be analyzed and one or more earlier images;

analyze the image to be analyzed; including comparing the image to the one or more earlier images; and determine at least one duty cycle adjustment for at least one of said color channels for one group of one or more pixels of said information display system based at least in part on movement data associated with a user of said information display system and the analysis of the image; and a pixel driver for varying at least a first duty cycle for at least one of said color channels of said at least one group based at least in part on said duty cycle adjustment.

17. The information display system of claim 16, further comprising a movement sensor for determining said movement data.

18. The information display system of claim 17, wherein said movement sensor comprises a user head movement sensor.

19. The information display system of claim 17, wherein said movement sensor determines movement data by measuring motion of said user's eyes.

20. The information display system of claim 16, wherein said at least one color channel comprises a green color channel.

21. The information display system of claim 20, wherein said duty cycle calculator calculates a plurality of duty cycle adjustments for a plurality of groups of pixels.

22. The information display system of claim 20, wherein said duty cycle calculator determines a size of said at least one group of pixels.

23. The information display system of claim 20, wherein said duty cycle calculator determines a shape of said at least one group of pixels.

24. The information display system of claim 20, wherein said duty cycle calculator determines a location of said at least one group of pixels.

25. The information display system of claim 16, wherein said at least one color channel comprises a green color and a red color channel.

26. The information display system of claim 16, wherein said at least one color channel comprises a green color, a red color channel, and a blue color channel.

27. The information display system of claim 16, wherein said movement data comprises predicted movement data.

28. An information display system for compensating for visual artifacts, comprising:

a plurality of color channels;

a duty cycle calculator configured to:

receive movement data associated with a user of said information display system;

receive image data comprising an image to be analyzed and one or more earlier images;

analyze the image to be analyzed, including comparing the image to the one or more earlier images; and determine at least one duty cycle adjustment for at least one of said color channels for one group of one or more pixels of said information display system based at least in part on the analysis of the image, the duty cycle adjustment indicating a first duty cycle for the at least one of said color channels and a second duty cycle for another of said color channels, wherein the first duty cycle is different from the second duty cycle; and a pixel driver configured to vary the respective duty cycles of said plurality of color channels based at least in part on said determined duty cycle adjustment.

29. The information display system of claim 28, wherein said at least one color channel comprises a green color channel.

30. The information display system of claim 28, wherein said at least one color channel comprises a green color channel, a red color channel, and a blue color channel.

31. The information display system of claim 28, wherein said at least one color channel comprises a green color channel and a blue color channel.

32. A method of compensating for visual artifacts on an information display comprising a plurality of color channels by varying a duty cycle on an individual color channel basis of portions of said information display, the method comprising:

receiving movement data associated with a user of said information display;

receiving image data comprising an image to be analyzed and one or more earlier images;

analyzing the image to be analyzed, including comparing the image to the one or more earlier images; and determining at least one duty cycle adjustment for at least one of said color channels of said information display based at least in part the received movement data and the analysis of the image, the duty cycle adjustment indicating a first duty cycle for the at least one of said color channels and a second duty cycle for another of said color channels, wherein the first duty cycle is different from the second duty cycle; and varying the respective duty cycles of said plurality of color channels based at least in part on said determined duty cycle adjustment.

* * * * *